US007008161B2

(12) United States Patent
Wagner

(10) Patent No.: US 7,008,161 B2
(45) Date of Patent: Mar. 7, 2006

(54) MATERIAL TRANSPORT SYSTEM

(75) Inventor: Jeffrey P. Wagner, Greenfield, IN (US)

(73) Assignee: Therm-All, Inc., North Olmsted, OH (US)

( * ) Notice: Subject to any disclaimer, the term of this patent is extended or adjusted under 35 U.S.C. 154(b) by 201 days.

(21) Appl. No.: 10/426,981

(22) Filed: Apr. 30, 2003

(65) Prior Publication Data

US 2004/0175256 A1 Sep. 9, 2004

Related U.S. Application Data

(60) Provisional application No. 60/452,047, filed on Mar. 4, 2003.

(51) Int. Cl.
*E04G 21/14* (2006.01)

(52) U.S. Cl. ..... 414/10; 52/749.12

(58) Field of Classification Search ..... 44/10; 52/404.1, 478, 746.11, 749.12; 242/598.5
See application file for complete search history.

(56) References Cited

U.S. PATENT DOCUMENTS

| | | | | |
|---|---|---|---|---|
| 3,969,863 | A | | 7/1976 | Alderman |
| 3,992,847 | A | | 11/1976 | Heath |
| 4,078,355 | A | | 3/1978 | Clemensen |
| 4,383,398 | A | | 5/1983 | Tipton |
| 4,864,837 | A | | 9/1989 | Fielden, Jr. |
| 4,967,535 | A | * | 11/1990 | Alderman ..... 52/749.12 |
| 5,664,740 | A | | 9/1997 | Alderman et al. |
| 5,685,123 | A | | 11/1997 | Alderman et al. |
| 5,911,385 | A | | 6/1999 | Neifer et al. |
| 5,921,057 | A | | 7/1999 | Alderman et al. |
| 6,041,568 | A | | 3/2000 | Alderman et al. |
| 6,195,958 | B1 | * | 3/2001 | Neifer et al. ..... 52/749.12 |
| 6,247,288 | B1 | * | 6/2001 | Harkins ..... 52/746.11 |
| 2002/0053181 | A1 | | 5/2002 | Wagner |

* cited by examiner

*Primary Examiner*—James R. Bidwell
(74) *Attorney, Agent, or Firm*—Wegman Hessler & Vanderburg

(57) ABSTRACT

A material transport system for delivering and dispensing a large capacity of materials at a construction site using a plurality of removable carriages, each bearing a roll of material, mounted on a movable frame. The frame comprises a pair of dual powered axles each driving either a set of drive flanged rollers, or a set of conveyors, for moving the system along purlins, or joists, of a building. The flanged rollers are used when dispensing of material to a side wall of the building is desired and the building is roofless, and when dispensing of material to an end wall of the building is desired and the building is roofed. The conveyors, which are removably mounted to the underside of the material transport system, are used for dispensing material to a side wall when the building is roofed, and when dispensing material to an end wall when the building is roofless. In either case, the flanged rollers, or the conveyors, are simultaneously driven by a common pair of dual-powered axles to negotiate the constant or changing elevation of a building's roof structure.

34 Claims, 11 Drawing Sheets

MATERIAL TRANSPORT SYSTEM

CROSS-REFERENCE TO RELATED APPLICATION

This application claims the priority benefit of U.S. Provisional Patent Application No. 60/452,047 filed Mar. 4, 2003.

BACKGROUND OF THE INVENTION

1. Field of Invention

This invention relates to moving materials on walls of building structures, and more particularly, to an apparatus for use in installing insulation, or other flexible materials, or for generally moving materials on walls of building structures.

2. Description of Related Art

During the fabrication of metal frame buildings, wall installation is commonly installed by placing a roll of insulation on a carriage and supporting the carriage on the building roof framework. The carriage travels across the roof along a side wall as strips of insulation are dispensed from the roll and secured to the building wall. Typical apparatii of this type are disclosed in U.S. Pat. Nos. 3,992,847 and 4,078,355. In another arrangement, disclosed in U.S. Pat. No. 4,383,398, a cage supported on tines of a forklift carries two rolls of insulation with one being above the other.

When an apparatus of the type described above is used along a portion of the roof that is horizontal, the insulation hangs straight down for easy installation. However, when such an apparatus is used along a building wall where the roof slopes from one end of the wall to another end of the wall, the carriage is inclined to the horizontal from side-to-side and strips of insulation do not hang straight down from the carriage. As a result, the insulation is slanted, or otherwise misaligned, relative to the walls it is to be installed in and additional handling of the insulation is required prior to final installation of the insulation. Therefore, it would be desirable to have an arrangement for leveling the axis of the roll of insulation when the carriage is inclined so that the insulation, or other material, delivered from the carriage is properly aligned with the walls.

Further, the carriage tends to slide, or lose traction, when traveling uphill or downhill on a sloping roof. Thus, it would be desirable to provide a positive drive arrangement to ensure that the carriage will not slip, or lose traction, even when traveling along the incline of a sloping roof. Such drive arrangement could be a positive drive system.

An apparatus of the type described above commonly supports only one roll of insulation, or a second roll that is not conveniently movable to a dispensing position. As a result, manual intervention is often required to supply additional rolls of insulation material, or to position a second roll appropriately for dispensing from the carriage. Thus, it would be desirable to have a carriage system whereby a plurality of rolls of insulation, or other materials, is supported and is easily indexed when a prior roll of insulation, or other material, is exhausted. In this manner, all, or a significant portion, of a building wall may be insulated before it is necessary to reload the carriage with additional rolls of insulation.

SUMMARY OF THE INVENTION

This invention provides a material transport system for delivering and dispensing a large capacity of materials at a construction site using a plurality of removable carriages, each bearing a roll of material, mounted on a movable frame. The frame comprises a pair of dual powered axles each driving either a set of drive flanged rollers, or a set of conveyors, for moving the system along purlins, or joists, of a building. Thus, the changing elevation of purlins, or joists, of the building corresponding to the slope of the roof along an end wall of the building, or the constant elevation of the building along side walls of the building, may be negotiated by either the flanged rollers, or the conveyors.

In conditions where roof sheeting has not yet been installed, the flanged rollers are used when installation of material to a side wall of the building is desired, and the pair of conveyors, which are removably mounted to the underside of the flanged rollers, are used when installation of material to an end wall of the building is desired. In conditions where roof sheeting has been installed, the flanged rollers are used for installing material at the end wall by moving the system along the changing elevation of purlins, or joists, of the building corresponding to the slope of the roof at the end walls of the building, and the pair of conveyors are used for installing material to a side wall of the building. In each case, the flanged rollers, or the conveyors, are simultaneously driven by a common pair of dual-powered axles. Experimentation has determined that use of a single conveyor with a single set of flanged rollers undesirably skews the materials dispensed when negotiating the slope of an end wall. Accordingly, the dual conveyors are preferred to better align the materials dispensed when negotiating an end wall slope. Additionally, experimentation has determined that the substantially increased mass of installed material results in a significant rolling resistance of the material transport system. To overcome this rolling resistance, it is beneficial that each point of contact with the roofing structure, or exposed purlins, assist in the movement of the material transport system.

This invention separately provides that each conveyor is comprised of a plurality of pulleys spaced approximately three inches apart from one another. Each conveyor includes a single dual-grooved drive pulley which in turn moves two high-friction belts. One of these belts extends over one set of a plurality of pulleys in one direction, and the other belt extends in an opposite direction over another set of a plurality of pulleys. Thus, by rotating the belts of each conveyor the material transport system is moved from one position to a next position along the end wall, for example, of the building. The full compliment of pulleys thus frictionally engages the belts with the purlins, or joists, the system is riding upon. These conveyors are generally used in pairs in which one conveyor extends substantially in one direction while the other conveyor is inversely positioned relative to the first conveyor so as to extend substantially in the opposite direction. At least one common drive axle links the pair, or pairs, of conveyors. A typical application would have two pairs of conveyors, in fore and aft positions relative to the roll dispensing carriage. That is, one pair is mounted near one end of the material transport system and another pair mounted at an opposite end of the material transport system. Additional individual conveyors or pairs of conveyors could also be added to increase the loading capacity of the material transport system.

This invention separately provides that each conveyor is comprised of a first toothed drive pulley at one end of each conveyor, a second idler pulley at a position very near the first pulley, and a third idler pulley at an end of each conveyor opposite the first pulley. A high-friction toothed belt is provided to ride over the first, second, and third pulleys of each conveyor and to engage the purlins, or joists, the system is riding upon. Thus, by rotating the drive pulley and belt of each conveyor, the material transport system is moved from one position to a next position along the side wall or end wall of the building as desired. These conveyors are generally used in pairs in which one conveyor extends substantially in one direction while the other extends substantially inverse the first conveyor so as to extend in the opposite direction. At least one common drive axle links the pair, or pairs, of these conveyors. A typical application would have two pairs of these conveyors, one pair mounted near one end of the material transport system and the other pair mounted at an opposite end of the material transport system. Additional individual conveyors or pairs of conveyors could also be added to increase the loading capacity of the material transport system.

This invention separately provides a material transport system for delivering and dispensing a large capacity of materials at a construction site wherein the frame of the material transport system bearing the materials is adjustable to compensate for varying roof pitches. Upright structures of the frame are provided with a set of holes at elevations corresponding to standard roof pitches, for example a slope having a 1-inch rise to a 12 inch run. Pins are insertable into the desired hole on each upright structure so that the roll of material to be dispensed is securely mounted to the frame for dispensing at a proper angle relative to the intended end wall. In this manner, the materials dispensed from the material transport system are properly aligned with end walls, for example, even as the material transport system negotiates the different elevations of the end wall slope. When the materials are dispensed to a side wall, pins are likewise inserted into a hole of a same elevation in each upright structure to ensure that the materials are evenly dispensed and appropriately aligned for installation into a side wall.

This invention separately provides a material transport system for delivering and dispensing a large capacity of materials at a construction site wherein the indexing, or re-supplying, of subsequent rolls of materials is more readily accommodated by removing a first, or otherwise preceding, supply carriage to position a subsequent supply carriage, with a subsequent roll of material, for dispensing at a dispensing end of the system. Each supply carriage is thus removable from the frame of the system by removal of a pin, or set of pins, that otherwise secures each supply carriage to the frame. Once a preceding supply carriage is removed, a subsequent supply carriage may be positioned at the dispensing end of the frame just vacated by the removed supply carriage. The subsequent supply carriage is then secured by the pin, or set of pins, that originally secured the preceding supply carriage to the frame. Any remaining supply carriages are similarly secured by a pin, or set of pins, to the frame until repositioning to the dispensing position is desired.

This invention separately provides a tensioning device that renders the insulation, or other material, taut after a desired amount of the insulation, or other material, has been dispensed. The tensioning device is a rotationally indexable device that is operable from either side of the system.

In the various exemplary embodiments of this invention, the dimensions of the material transport system enable the system to be moved from one construction site to another in a standard full-sized pick-up truck. Further, the frames of multiple material transport systems may be nested with one another so as to transport a plurality of material transport systems in one vehicle at one time.

This invention separately provides that a plurality of the various exemplary embodiments of the material transport system described above may be linked to one another to form a material transport system train. This linking can be comprised of at least one of mechanically linked frame sections, mechanically linked drive axle sections, or electrically linked drive motor control systems. The linking of various material transport systems to one another may also be comprised of combinations of mechanically linked frame section, mechanically linked drive axle section, or electrically linked drive motor control systems. Such a train, comprised of linked material transport systems., enables even larger amounts of materials to be moved at a construction site, if needed.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail with reference to the following figures, wherein.

DETAILED DESCRIPTION OF EXEMPLARY EMBODIMENTS

Figure 1:
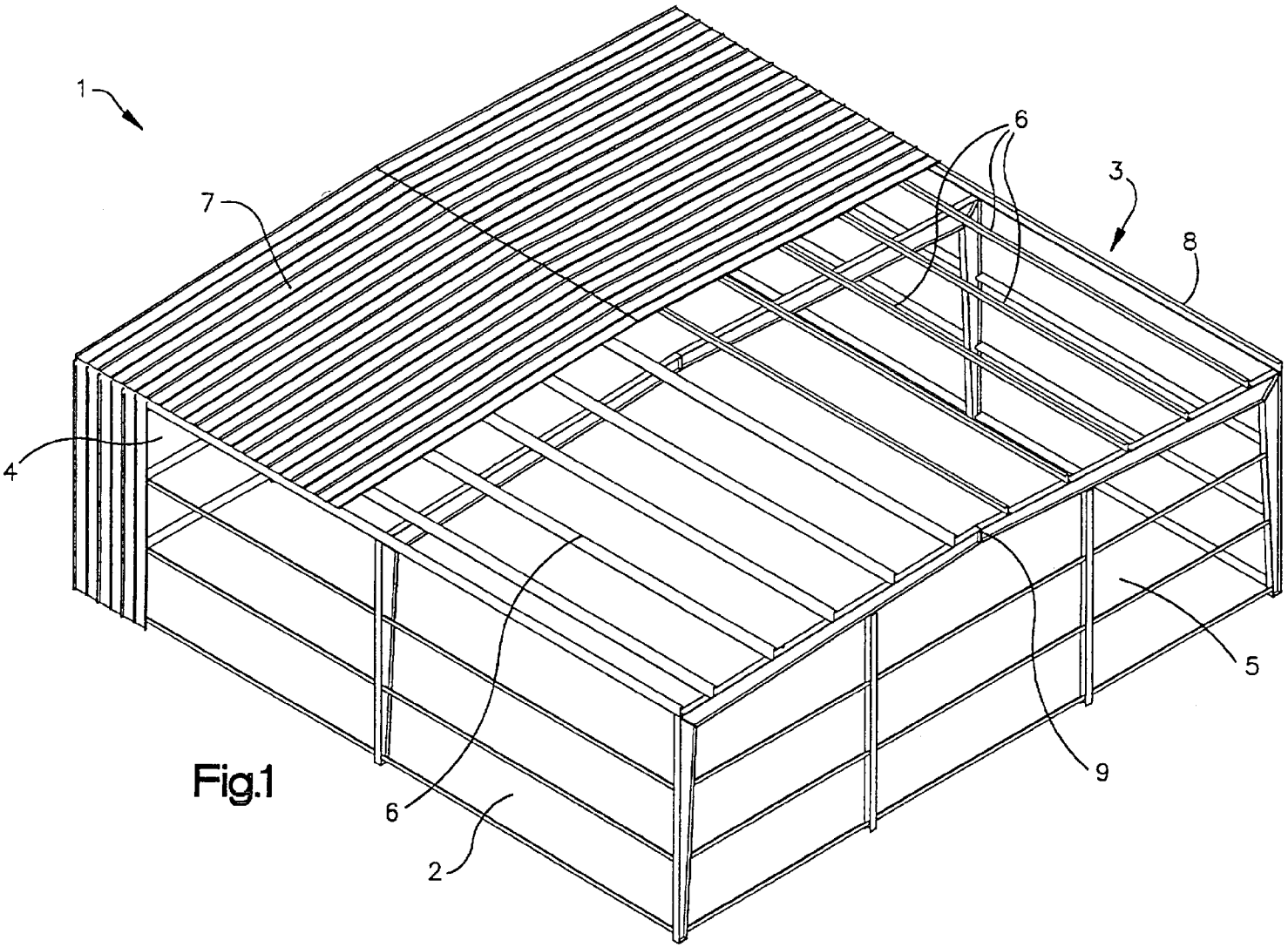
FIG. 1 illustrates an exemplary building structure on which the material transport system of the invention may be used.

Referring now to the FIGS. 1–11 of this Application, FIG. 1 shows an exemplary building 1 upon which the material transport system 100 (FIG. 2) of the invention might be used. The building 1 is comprised of opposed side walls 2, 3, opposed end walls 4, 5, and purlins 6 underlying a roof 7. The roof 7 thus slopes upwardly from an eave-strut 8 at a top of each side wall 2, 3 to a ridge 9 at the top of the building 1. The purlins 6 span longitudinally across the building 1 from end wall 4 to end wall 5. The purlins 6 further are spaced approximately equi-distant from one purlin to another purlin from the eave strut 8 to the ridge 9 in a generally parallel manner relative to the eave-strut 8 at the top of each side wall 2, 3.

Figure 2:
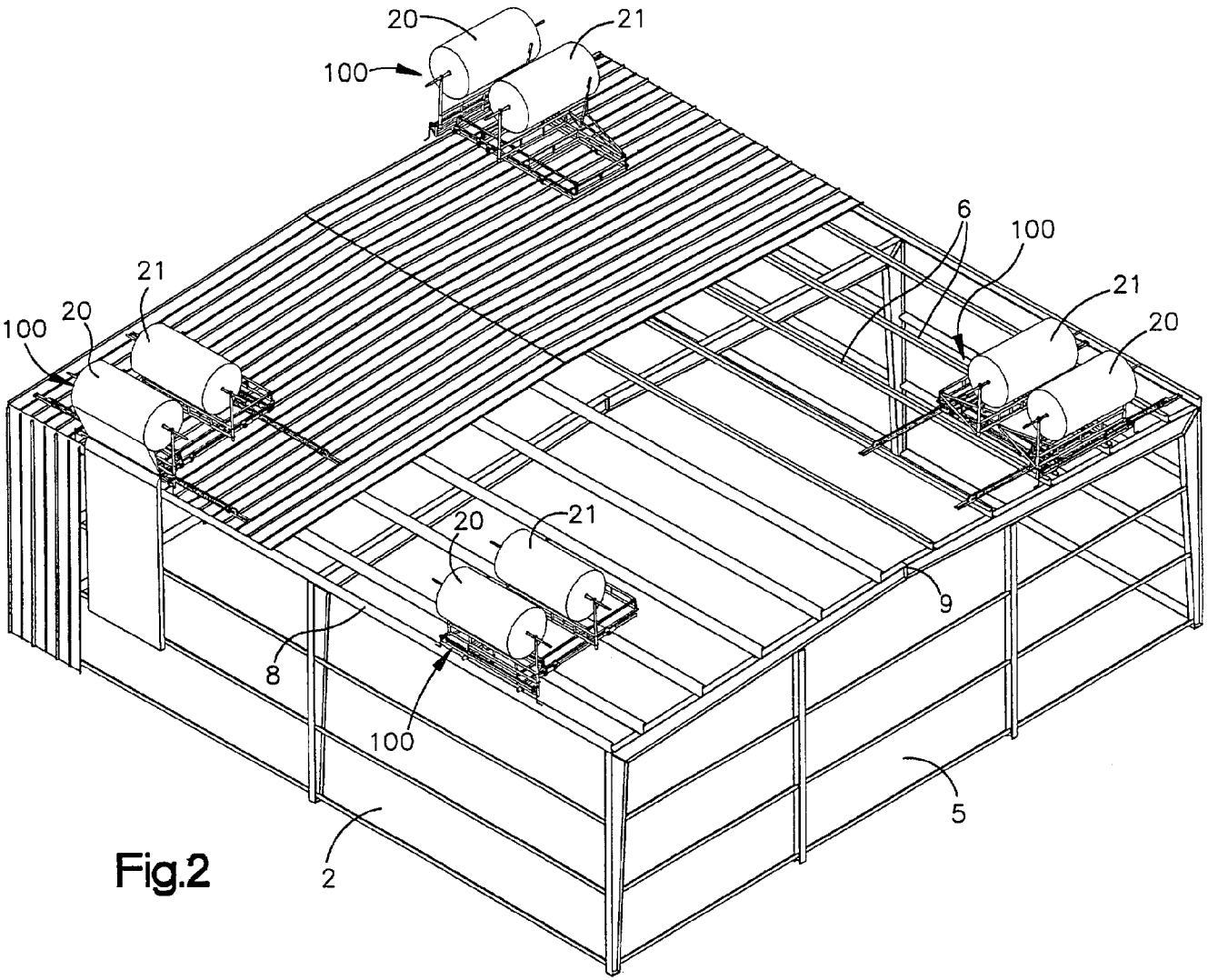
FIG. 2 illustrates an overhead view of an exemplary material transport system according to the invention riding on purlins, or joists, of a building.

FIG. 2 shows an overhead view of an exemplary embodiment of the material transport system 100 atop the building 1. The building 1 shown is generally roofless. The material transport system 100 shown in FIG. 2 generally traverses across the longitudinal span of the purlins 6, generally parallel to the eave-strut 8, so that material from one of rolls 20, 21 is dispensed in alignment with the side wall 2, for example. Because the elevation of the side walls 2, 3 is constant, and because the elevation of the material transport system 100 on the purlins 6 is constant as it traverses across the purlins 6, the material dispensed from one of the rolls 20, 21 is also constantly dispensed in alignment with the side walls 2, 3 as desired.

Were the material transport system 100 re-oriented to dispense material from one of the rolls 20, 21 to the end walls 4, 5 of the roofless building 1, then the material transport system 100 would further comprise belted conveyors 140 (FIG. 3) to negotiate the changing elevation of the roof 7 as the purlins 6 ascend from the side walls 2, 3 to the ridge 9 of the building 1. The changing elevation of the roof 7 at the top of the end walls 4, 5 corresponds to the rise versus the run slope of the roof 7. The span of the conveyors 140 add stability to the material transport system 100 as it traverses the changing elevations of the end walls 4, 5, for example.

The material transport system 100 includes flanged rollers 130 (FIG. 3) on the underside of the frame 110 of the system 100. High friction sections 134 of the flanged rollers 130 ride over the exposed purlins 6, joists, eave-strut 8 of a roofless building 1 when dispensing material from one of the rolls 20, 21 to the side walls 2, 3. Of course, though the building 1 shown in FIGS. 1 and 2 is generally roofless, the high friction wheels 134 of the flanged rollers 130 could instead traverse across the roof 7 of the building 1 when dispensing material to end walls 4, 5 were the roof 7 already in place. Low friction flange sections 135 of the flanged rollers 130 help to guide the wheels 130 and maintain a generally straight path for the system 100 as it traverses the roof. The low friction flange sections 135 could be made to comprise a coating such that damage to the materials comprising the roof 7 is minimized and power requirements are reduced. On the other hand, the high friction central sections 134 of the flanged rollers 130 could be comprised of a coating such that the central sections 134 grip and travel smoothly over the desired portions of the building.

Thus, the frame 110 of the material transport system 100 traverses the purlins 6 in a path generally parallel to the eave strut 8 along the top of the side walls 2, 3, for example. As the desired length of the insulation, or other material, is dispensed from one of the rolls 20, 21 the bottom portion of the insulation, or other material, may be attached adjacent the bottom of the side walls 2, 3 by screws, or other suitable fasteners, for example.

Figure 3:
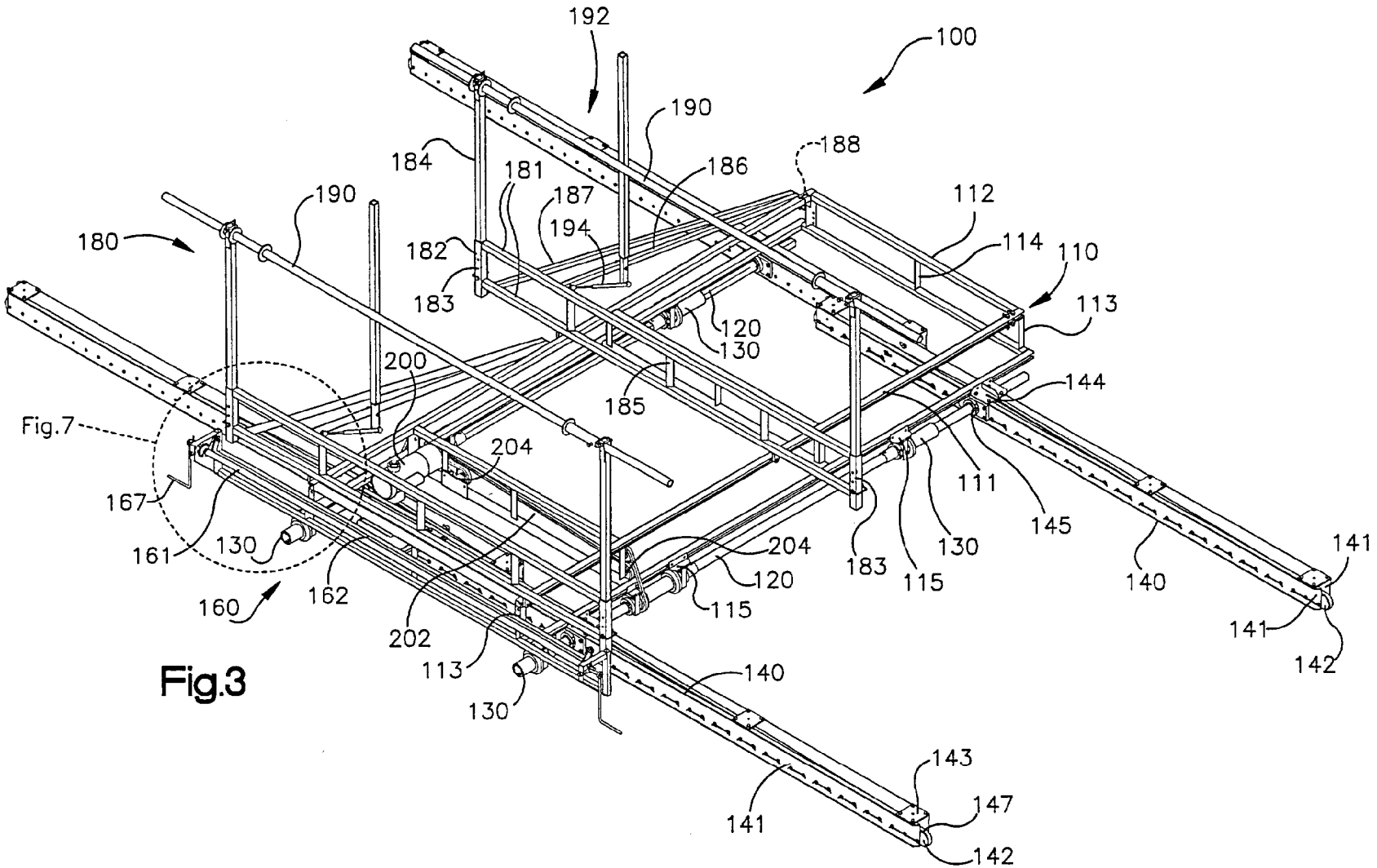
FIG. 3 illustrates a perspective view of a first exemplary embodiment of the material transport system according to the invention.

FIG. 3 shows a perspective view of a first exemplary embodiment of the material transport system 100 according to the invention. The material transport system 100 comprises a generally rectangular frame 110 comprised of variously lengthed u-shaped channel struts 111, 112 fastened together by cornerposts 113. The cornerposts 113 may be comprised of angle-irons, for example, to which the upper and lower struts 112 and 111 are attached. Thus, the longest struts 111 comprise the longer sides of the rectangular frame 110, the shorter struts 112 comprise the ends of the frame 110, and the cornerposts 113 are the vertical members joining corresponding upper and lower struts 111, 112 of the frame 110 together. Additional posts 114 may be place between the cornerposts 113 to increase the strength and rigidity of the frame 110 and to join the upper and lower sets of struts 111, 112 together. The posts 114 are comprised of square tubing, for example, that attach at either end of the posts 114 to the respective struts 111, 112. The majority of the framing system is assembled by welding the various struts, cornerposts, and posts 111–114 together. A suitable fastener is contemplated for securing the other components together throughout this application. Such fasteners may be screws, bolts, pins, clips, straps, or other known or later developed fastening devices.

Figure 4:
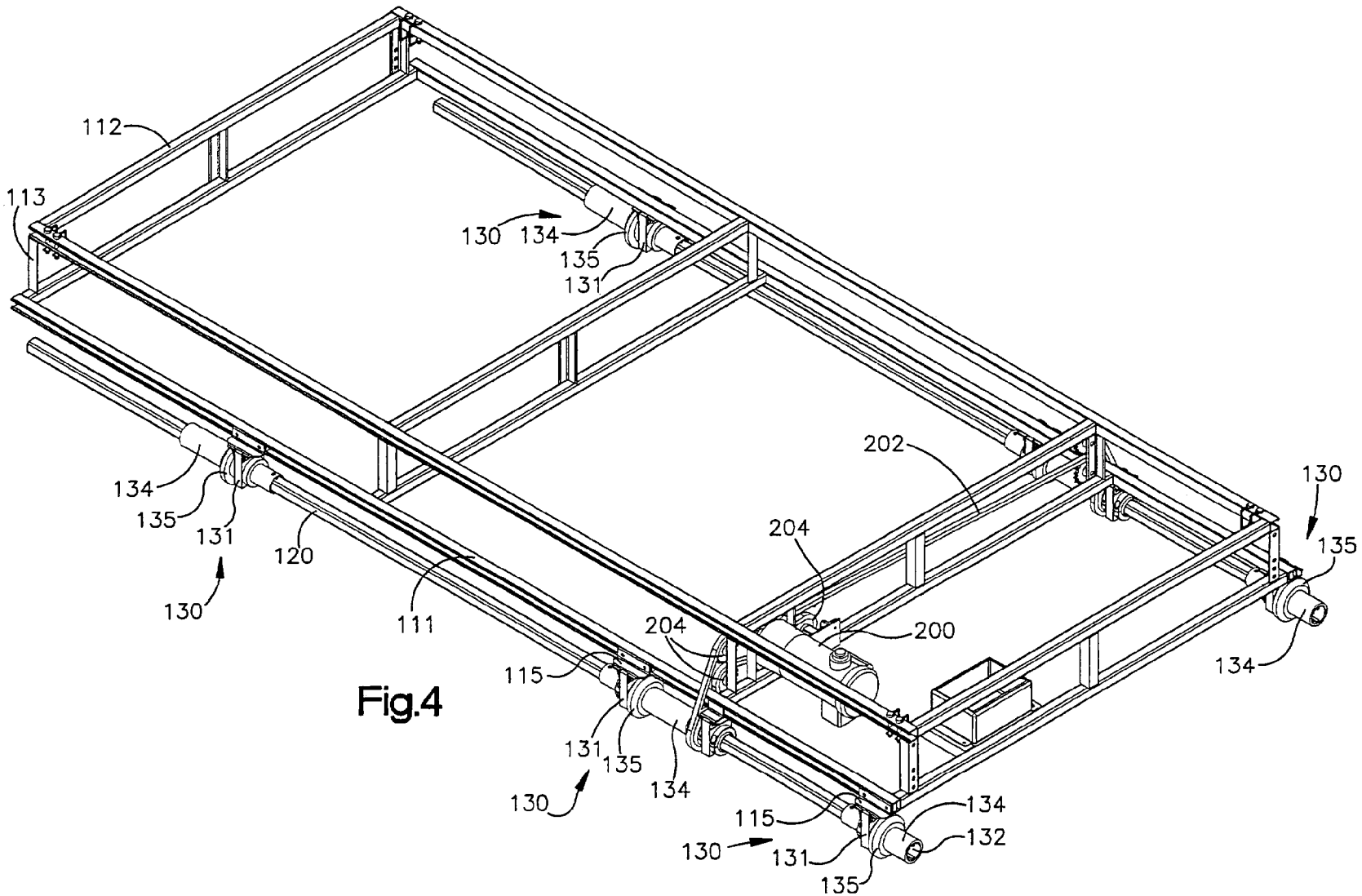
FIG. 4 illustrates another view of the first exemplary embodiment of FIG. 3.

Referring to FIGS. 3 and 4, a substantially square drive axle 120 is mounted on the underside of the frame 110 by attachment to each of the lower struts 111. A plurality of, for example three, flanged rollers 130 are slidably mounted on each of the drive axles 120 by a collar 131 and a square fitting 132 provided with each flanged roller 130. Each of the slidably mounted flanged rollers 130 is thus driven by the square drive axle 120 when motor 200 is operated causing a chain 202 arranged over a series of sprockets 204 to rotate the drive axle 120. Rotation of the drive axle 120 thus causes the flanged rollers 130 to rotate and traverse the material transport system 100 across the exposed purlins 6, or the roof 7, permitting material to be dispensed from the rolls 20, 21 along a side wall 2, 3.

Figure 5:
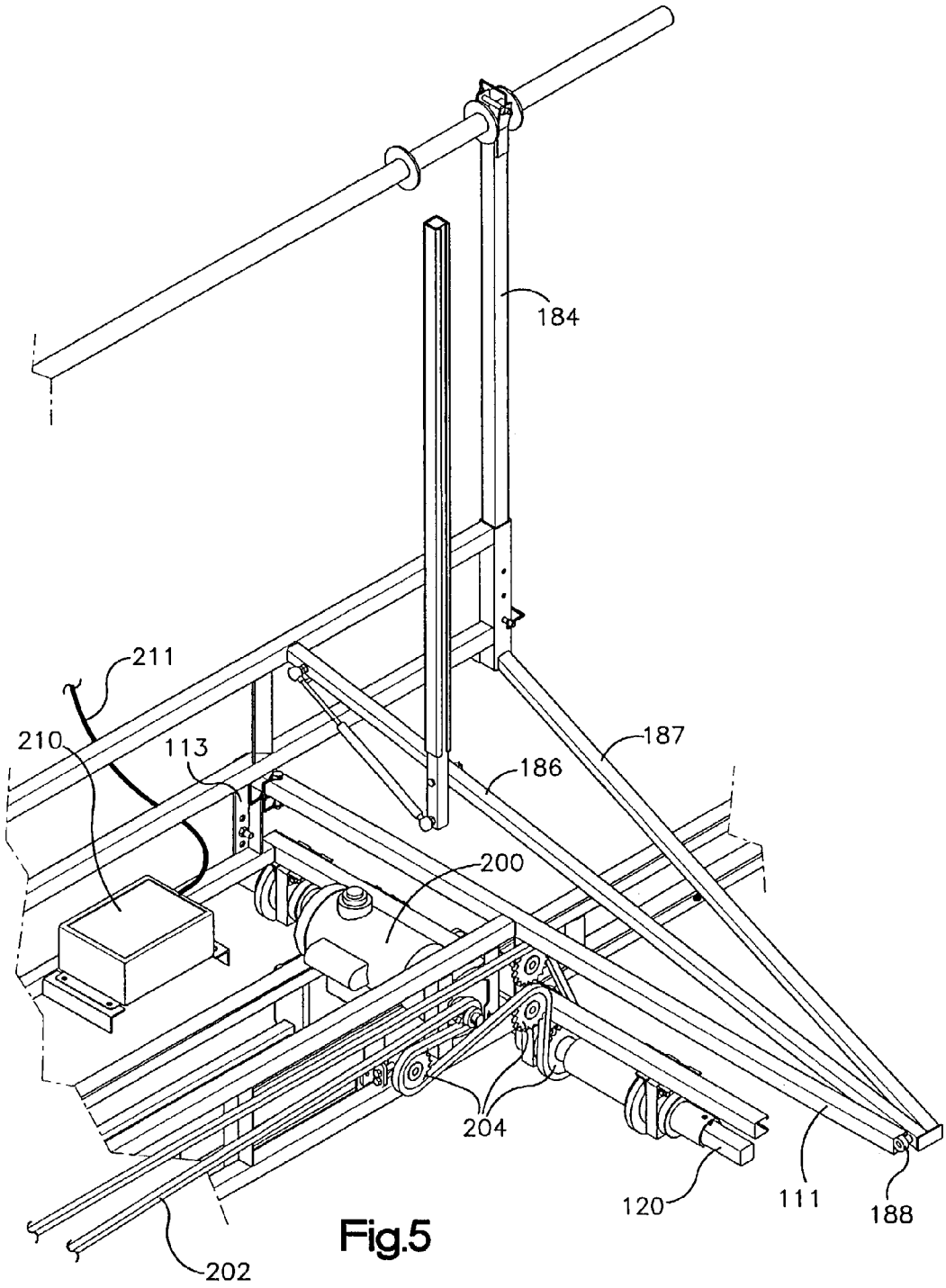
FIG. 5 illustrates an exemplary motor arrangement according to the invention.

As shown in FIG. 5, the motor 200 may comprise a controller 210 mounted to the frame 110 of the material transport system 100. A tethered line 211 attached to the controller 210 permits an operator to direct the motion of the material transport system 100 in the forward, reverse or stopped directions. The motor 200 may as well comprise a speed feature to control the rate at which the material transport system 100 is moved.

L-shaped plates 115 (FIG. 4) on each square drive axle 120 attaches each square drive axle 120 to a respective one of the lower struts 111 by fastening one end of the L-shaped plate 115 to the lower strut 111, and fastening another end of the L-shaped plate 115 to the collar 131 provided with each of the flanged rollers 130. The fastener permits each flanged roller 130 to be positioned as desired along the square drive axle 120. Each collar 131 thus mounts a flanged roller 130 to the square drive axle 120 by sliding the square fitting 132 and the collar 131 onto the corresponding square drive axle 120. As a result of this configuration, the flanged rollers 130 may be moved along the square drive axle 120 by loosening the fastener fastening the L-shaped plate 115 to the strut 111 and sliding the flanged roller 130 to a different position on the square drive axle 120. Thereafter, the fastener can be re-tightened to secure the flanged roller 130 in its new position on the square drive axle 120. The positioning of the flanged rollers 130 in different positions becomes necessary when attaching, or detaching, the conveyors 140, both of which will enable the material transport system 100 to move across the roof or exposed purlins of the building as needed according to roofed or roofless conditions. Some flanged rollers may be classified as uphill or downhill flanged rollers, depending on the direction in which the rolling surface extends away from the flanged surface. If necessary, the flanged rollers can be repositioned to accommodate various application needs.

FIG. 3 further shows an exemplary embodiment of the conveyors 140 attached to the underside of the lower struts 111. Each conveyor 140 generally comprises two substantially parallel frame members 141 forming a channel housing a plurality of pulleys 142 therein. The frame members 141 are joined by plates 143 mounted to a top of the frame members 141. An L-shaped plate 144 (FIG. 3) also attaches the top of the frame members 141 to the lower strut 111 of the frame 110 of the material transport system 100.

Two of the plurality of pulleys 142 provided in the conveyors 140 are drive pulleys 145 (FIG. 3) provided in each conveyor 140. The drive pulleys 145 are provided with square fittings corresponding to the square drive axle 120. The conveyors 140 are thus mounted to the material transport system 100 by sliding the square fittings of the two drive pulleys 145 over the square drive axle 120. Two conveyors 140 are preferably attached to one another at either end of the frame 110 in order to provide an increased span of the conveyors 140 over the purlins 6 or roof 7, and thereby to provide increased stability of the material transport system 100. In the case of pairs of attached conveyors 140 at both ends of the material transport system 100, the square drive axle 120 links pairs of drive pulleys 145 at each end of the system 100 and urges the material transport system in the desired direction. Of course, alternatively, a single conveyor 140 may be mounted at each end of frame 110, if desired.

Figure 9:
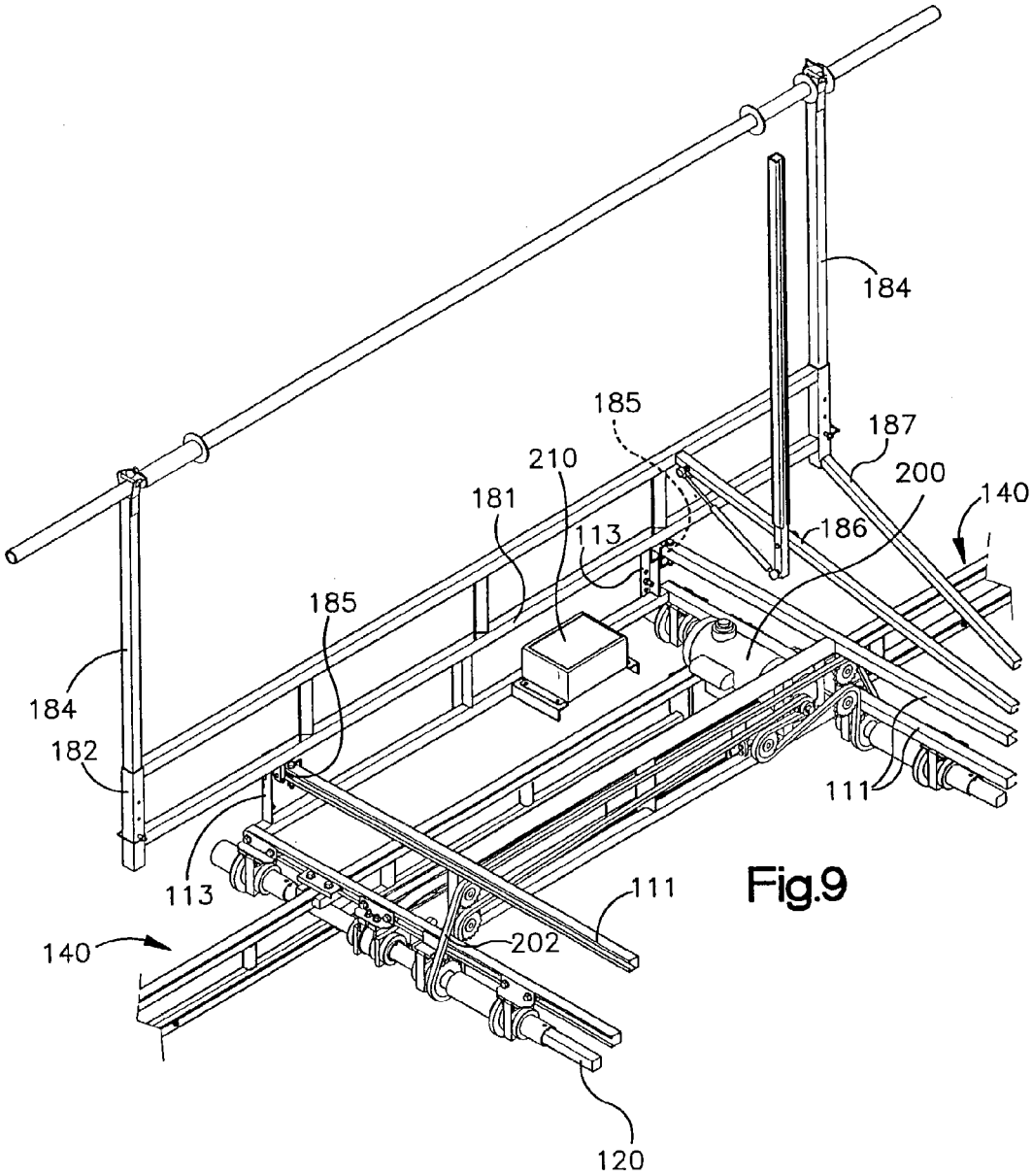
FIG. 9 illustrates a partial view of the roll supply carriage mounted to the material transport system according to the invention.

A belt 147 rides over the plurality of pulleys 142, including the dual-groove drive pulley 145, in each conveyor 140. As shown in FIGS. 3 and 9, the conveyors 140 are generally perpendicular to the square drive axles 120 such that, operation of motor 200 causes a drive chain 202 to rotate the square drive axle 120, which thus rotates the drive pulley 145. As a result, belts 147 move over the plurality of pulleys 142 and drive pulleys 145 to move the material transport system 100 across the roof 7, or exposed purlins 6, of building 1 generally parallel to the eave strut 8 along the side walls 2, 3 or across the changing elevation of the purlins 6 for end walls 4,5 in order to dispense material from the rolls 20, 21.

Thus, operation of the motor 200 and drive chain 202 causes the high friction sections 134 of the flanged rollers 130 either to traverse roof 7 for installing material at end walls 4,5 when the building has its roof 7 already in place, or causes the high friction sections 134 of the flanged rollers 130 to traverse the exposed purlins 6, joists or eave-strut 8, for installing material at side walls 2,3 when no roof 7 is in place. Alternatively, operation of the motor 200 and drive chain 202 causes the conveyors 140 to traverse the roof 7 for installing material at side walls 2,3 when the building has its roof 7 already in place, or to traverse the changing elevation of the purlins 6 for installing material at end walls 4,5 when the roof 7 is not in place. In this manner, the constant elevation of the roof 7 along the top of the side walls 2, 3 is negotiated by using either the high friction sections 134 of the flanged rollers 130 when roofed sheeting 7 is not present, or by conveyors 140 when roofed sheeting 7 is present. (FIG. 2). On the other hand, the changing elevation of the end walls 4, 5 of a building is negotiated by using the conveyors 140 when roofed sheeting 7 is not present, and is negotiated by the high friction sections 134 of the flanged rollers 130 when roofed sheeting 7 is present. In either case, the material transport system 100 is able to dispense material from rolls 20, 21 to side walls 2, 3 or end walls 4, 5 of a building 1 as desired.

As shown generally in FIG. 3, at a dispensing end of the frame 110 a tensioning unit 160 is provided. The tensioning unit 160 is mounted to the cornerposts 113 of the frame 110. The cornerposts 113 are provided with a plurality of holes 116 (FIG. 7) so that the tensioning unit 160 can be adjustably mounted to the cornerposts 113. The holes 116 permitting the adjustable mounting of the tensioning unit 160 to the cornerposts 113 of the frame 110 generally correspond to holes 183 (FIG. 8) adjustably mounting the roll supply carriage 180 to cornerposts 182 of the carriage 180, as will be discussed further below. While the tensioning unit 160 is shown at one end generally, it should be appreciated that the tensioning unit 160 could as well be provided at the opposite end of the frame 110 by mounting it to cornerposts 113, which are similarly provided with holes 116, at the opposite end of the frame 110. In this manner, increased versatility of the material transport system 100 is achieved.

Figure 6:
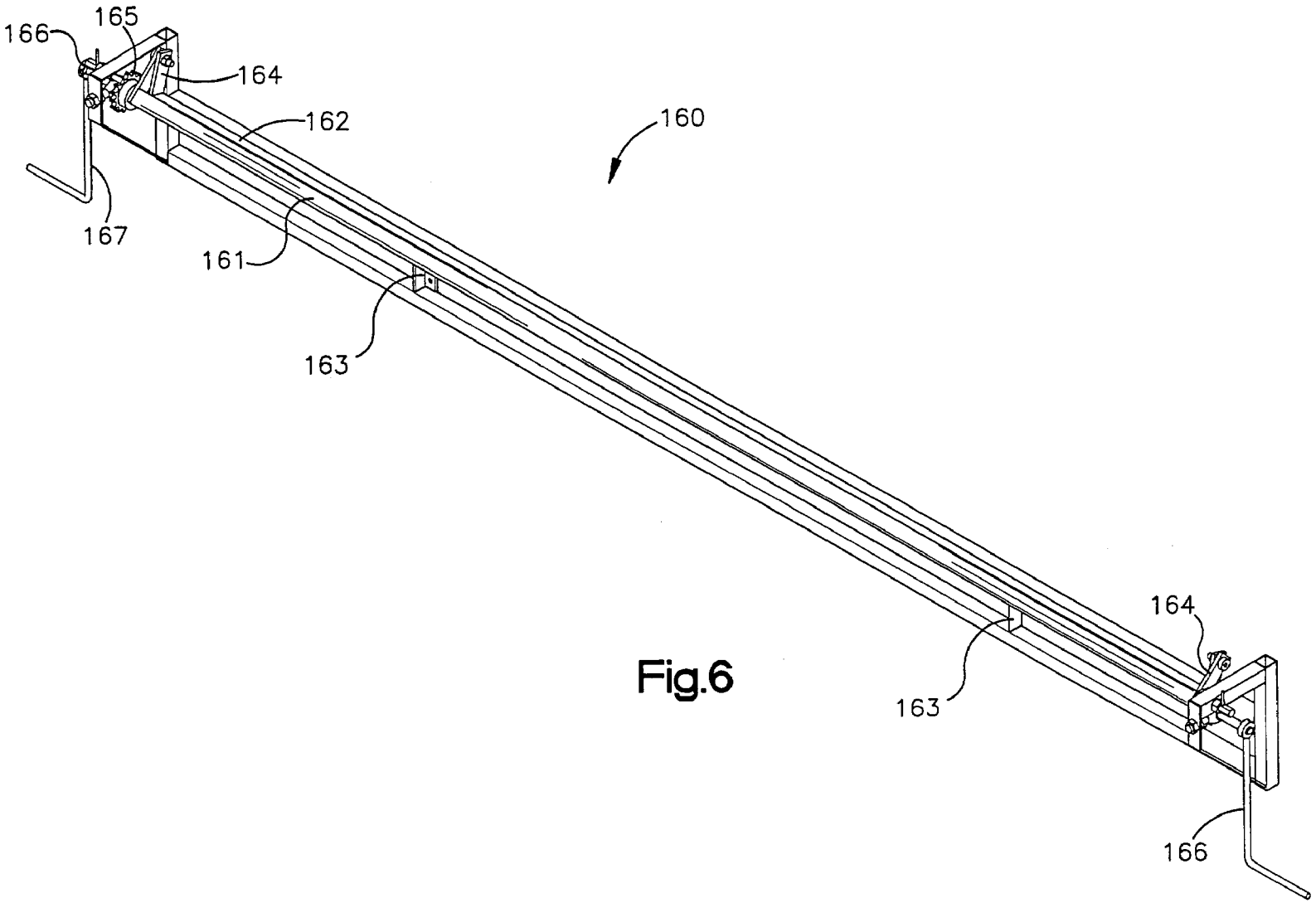
FIG. 6 illustrates a perspective view of the tensioning unit according to the invention.
Figure 7:
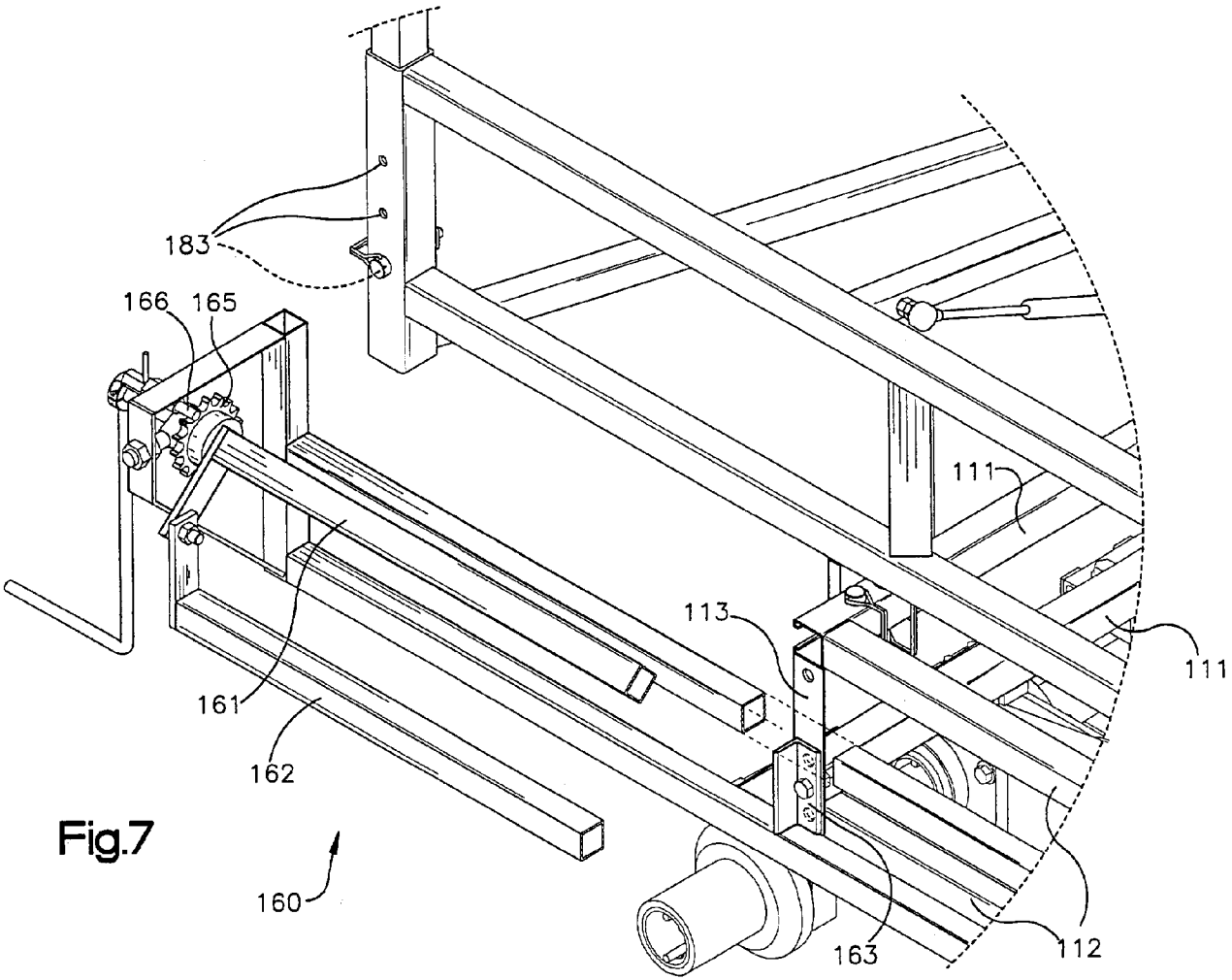
FIG. 7 illustrates a partial view of the tensioning unit for mounting to the material transport system according to the invention.

In either case, as shown in more detail in FIGS. 6 and 7, the tensioning unit 160 comprises a pair of spaced parallel pinch bars 161, 162 that extend between substantially parallel tensioning unit frame members 163 at the selected dispensing end of the frame 110. The frame members 163 mount to the cornerposts 113 with fasteners through holes 116 as discussed above. Pinch bar 162 is stationary, whereas pinch bar 161 is movable via a linkage 164 connecting both ends of the pinch bar 161 to the frame members 163 of the tensioning unit 160. A sprocket 165 is further provided on both sides of the movable pinch bar 161. The sprocket 165 is engaged by a spring loaded pin 166 provided on a side of each frame member 163 of the tensioning unit 160. A hand crank 167 is also provided at either end of the tensioning unit 160 to rotate the pinch bar 161 and crimp the insulation, or other material, passed between the pinch bars 161, 162. Providing such hand cranks 167 on either side of the tensioning unit renders operation of the tensioning unit 160 more accessible to operators, who may be at different locations relative to the tensioning unit 160.

As more readily seen in FIGS. 6 and 7, the pinch bars 161, 162 permit the insulation, or other material, provided from one of the rolls 20, 21 to pass between the pinch bars 161, 162 by retracting the spring loaded pin 166 and rotating the sprocket 165 to position the pinch bar 161 at its uppermost position, and then engaging the pin 166 with the sprocket 165 to lock the pinch bar 161 in this uppermost position. After the desired amount of insulation, or other material, is dispensed from one of the rolls 20, 21, the spring loaded pin 166 is again retracted and one of the hand cranks 167 is rotated to rotate the pinch bar 161 and crimp the insulation, or other material, between the pinch bar 161 and pinch bar 162. Then, the pin 166 is re-engaged with the sprocket 165 to locate the pinch bar 161 at the desired crimping position relative to the stationary pinch bar 162. By rotation of the pinch bar 161 via the hand crank 167, sprocket 165 and pin 166 configuration, the tensioning unit 160 comprises a gripping or pinching device applying tension to a strip of insulation, or other material, hanging downwardly along a side wall 2, 3 or end wall 4, 5 from the frame 110 of the material transport system 100.

Referring back to FIG. 3, two roll supply carriages 180 are provided on top of the frame 110 of the material transport system 100. Because the supply carriages 180 are essentially interchangeable, description of only one supply carriage 180 is provided herein.

Figure 8:
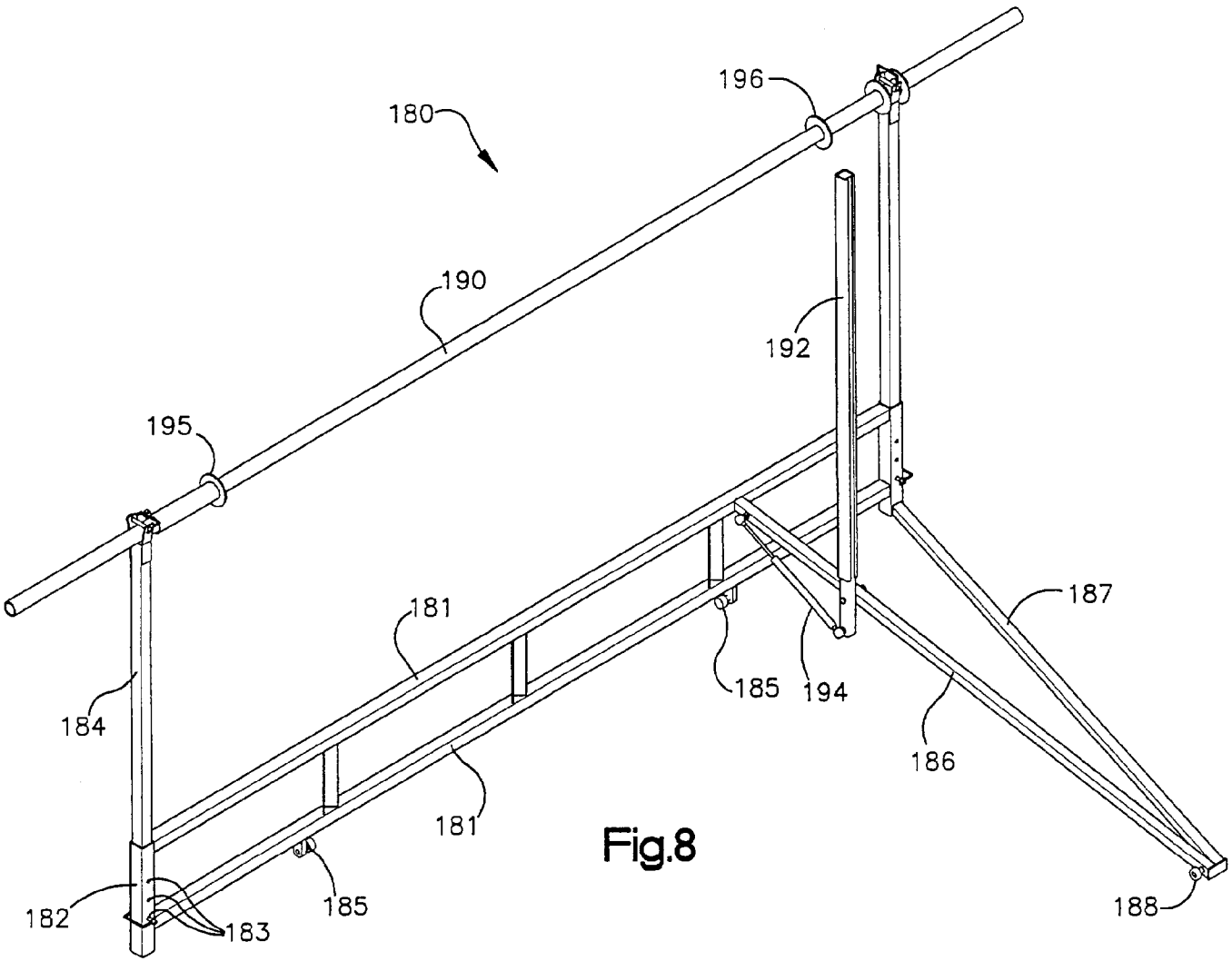
FIG. 8 illustrates a perspective view of the roll supply carriage according to the invention.

As shown more clearly in FIG. 8, each supply carriage 180 is comprised of upper and lower cross-members 181 joined by cornerposts 182, the cross-members 181 and cornerposts 182 comprising a rectangle. Each cornerpost 182 includes a series of holes 183. A pair of adjustable uprights 184 are insertable into the cornerposts 182. The pair of uprights 184 are adjustably attached to the cornerposts 182 by pins, or other fasteners, penetrating the holes 183 to securely position the uprights 184 at a level corresponding to the slope of the roof the material transport system 100 is to encounter. The cross-members 181, cornerposts 182 and uprights 184 are comprised of square tubing, for example. Additional posts may be added between the cornerposts 182 to join the upper and lower cross-members 181 and add strength or rigidity to the supply carriage 180. A roll supply bar 190 is provided across the uprights 184 for the rolls 20, 21 of insulation, or other material, to be dispensed by the material transport system 100. The roll supply bar 190 includes a stationary flange 196 and an axially adjustable flange 195 to contain various widths of rolls 20, 21.

The holes 183 in the cornerposts 182 of the carriage 180 generally correspond to the holes 116 (FIG. 7) of the cornerposts 113 that renders mounting of the tensioning unit 160 adjustable, as discussed earlier. In this manner, both the supply carriage 180 and the tensioning unit 160 may be oriented to accommodate the same roof slope by positioning the supply carriage 180 and tensioning unit 160 into the same level of holes 116, 183 for the respective components. As a result, the insulation, or other material, dispensed from the rolls 20, 21 is more likely to properly align with end walls 4, 5 of the building when negotiating the slope of the building 1 along the end walls 4, 5, or the constant elevation of side walls 2, 3.

FIG. 9 shows a partial view of how each supply carriage 180, is slidably mounted to each of the upper struts 111 of the frame 110 by the wheeled member 185 protruding down from the lower cross-member 181. The wheeled member 185 thus slides into the unshaped channel of upper strut 111 at the dispensing end of the frame 110. A similar wheeled member 185 protruding down from the lower cross-member 181 slides into the other upper strut 111 of the frame 110. These wheeled members 185 therefore provide two points of securement of each supply carriage 180 to the frame 110 by slidably attaching the lower cross-member 181 to the upper struts 111.

In addition, as best seen in FIGS. 3 or 8, a third point of securement of each supply carriage 180 to the frame 110 is provided by slidably mounting one side of each supply carriage 180 to an upper strut 111 via first and second support legs 186, 187 projecting from the upper and lower cross-members 181. The first and second support legs 186, 187 form a triangular-like support structure whereby one end of the first leg 186 is attached to an interior portion of upper cross-member 181 and one end of the second leg 187 is attached to the cornerpost 182 of the supply carriage 180. A free end of each of the first and second legs 186 and 187 abut one another and slidably connect wheeled member 188 to the upper strut 111. In this manner, each supply carriage 180 can be slidably removed from the frame 110 of the material transport system 100 by sliding the wheeled members 185, 188 of the supply carriage 180 along the upper strut 111 until the entire supply carriage 180 is removed, when one of the rolls 20, 21 supported by the supply carriage 180 is exhausted. In this manner, a subsequent supply carriage 180 may be similarly slid along its wheeled members 185, 188 to assume a position at the dispensing end, for example, of the frame 110 in order to provide a fresh supply of insulation, or other material, from another of rolls 20, 21 for dispensing. An additional function of securing the supply carriage 180 to the upper strut 111 by first and second support legs 186, 187 and wheeled members 185, 188 is to separate each material supply carriage 180 from another such supply carriage 180 such that as material is dispensed from roll 20 mounted on one carriage 180, it does not cause material on another roll 21 on the other carriage 180 to rotate and unravel in an opposite direction due to the frictional contact that would otherwise occur were the supply carriages 180 not separated.

Each carriage 180 is thus secured to the frame 110 of the material transport system 100 by pins, quick-clips, or other known or later developed fastening device as discussed earlier to preclude the wheel members 185, 188 and carriage 180 from sliding until sliding of the carriage 180 is desired as for removal, or re-positioning, of the supply carriage 180.

Dispensing of the insulation, or other material, provided on the supply bar 190 of each supply carriage 180 is controlled, in part, by a braking device 192 (FIG. 8) provided with the supply carriage 180. The braking device 192 may be, for example, a bar, tube, or other like structure sufficient to hold the outer layer of insulation, or other material, on the rolls 20, 21 in place until dispensing is desired. An extendible cylinder 194, which may be pneumatic, fluid-filled, or gas-charged, for example, attaches to a lower end of the braking device 192. The other end of the extendible cylinder 194 is attached to the upper cross-member 181 of the supply carriage 180. Thus, a free upper end of the braking device 192 is normally biased against the supply of insulation, or other material, of rolls 20, 21 on the supply bar 190 by the biasing force provided from the cylinder 194. In this manner, the insulation, or other material, does not unravel prematurely and is more likely to be dispensed evenly, in proper alignment with the side walls 2, 3, or end walls 4, 5 it is being provided to. Of course, one reasonably skilled in the art would readily appreciate that other biasing devices such as springs and linkages could as well be used in lieu of, or in addition to, the exemplary cylinder 194 and braking device 192 described.

Of course, it should be appreciated that though reference is made herein to removing a first supply carriage 180 when one of rolls 20, 21 is exhausted, and sliding a second supply carriage 180 to the dispensing end of the frame 110 of the material transport system 100, one skilled in the art could as readily slide the second supply carriage 180 first, or leave the supply carriage 180 of the exhausted roll in place while indexing the braking device 192 of the exhausted supply carriage in a full retracted position and merely drape the insulation, or other material, from the fresh roll of the second supply carriage 180 over the supply roll bar 190 of the first supply carriage 180, and proceed to dispense the insulation, or other material, from the second supply carriage in this manner, which may require removal, or re-positioning, of the braking device 192.

Figure 10:
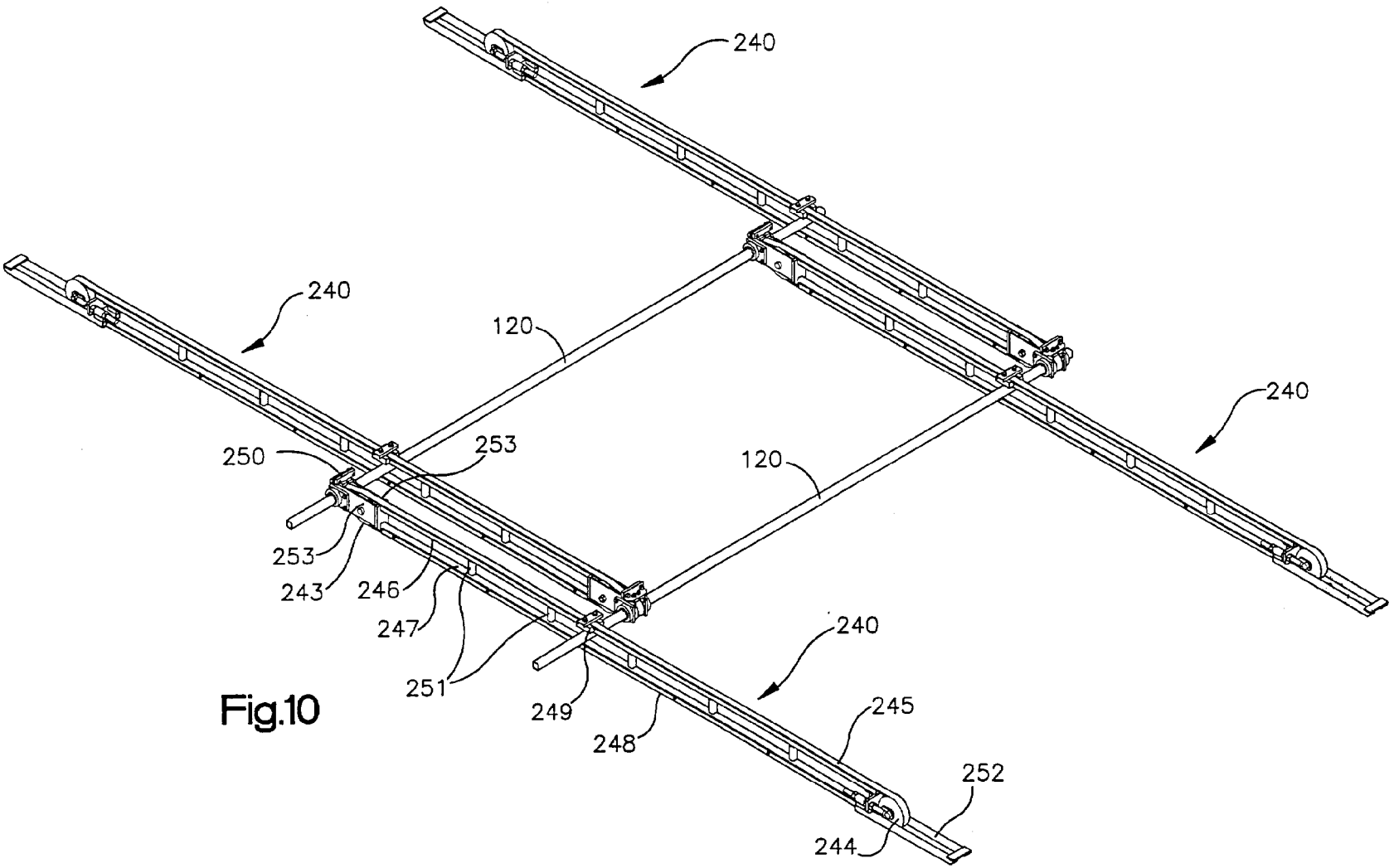
FIG. 10 illustrates a second exemplary embodiment of conveyors according to the invention.

FIG. 10 shows another exemplary embodiment of the conveyors 240 according to the invention. The conveyors 240 of this embodiment are each comprised of a series of square tubed upper frame members 246 and lower frame members 247, and flat side plate sections 253. The upper frame member 246 is joined to the lower frame member 247 by vertical posts 251 and the side plates 253. The conveyors 240 are formed by welding the majority of the frame members 246, 247, posts 251 and side plates 253 together, while the remaining components of the conveyors 240 are assembled by other fastening devices as discussed above.

Drive axle 120 thus engages a toothed drive pulley 242 (inside side plates 252) at one end of each conveyor 240. The toothed drive pulley 242 contacts toothed belt 245, which contacts idler pulleys 243, near the toothed drive pulley 242, and 244, at an end of the conveyor 240 opposite the toothed drive pulley 242. Each drive axle 120 thus engages each conveyor 240 only at the drive pulley 242, whereas the drive axle 120 otherwise merely passes between upper 246 and lower frame members 247, which is different from the described in previous embodiments.

In lieu of the plurality of pulleys as described in previous embodiments, conveyors 240 use a low-friction slider member 260 positioned between idler pulley 243 and the idler pulley 244 to contain and guide toothed belt 245. The slider member 260 thus spans the distance generally between idler pulleys 243 and 244 and is fastened below lower frame member 247 of each conveyor 240.

Each conveyor 240 slidably attaches to the lower strut 111 of the frame 110 by mounting bracket 250, which is located near the toothed drive pulley 242 at one end of the conveyor 240. A mounting plate 249, towards the middle of the conveyor 240, also attaches to the lower strut 111 of the frame 110.

Outriggers 252 may be used to extend the span of the conveyors 240 and increase the stability of the material transport system 100. Outrigger 252 is generally not intended to contact the building structure except in extreme cases were wind or other external forces may cause the material transport system to become unstable such that without the outrigger 252, the system would potentially fall through the building structure. Outrigger 252 is thus generally only necessary where the spacing of the purlins 6, or joists are so great as to merit the addition of said device.

As before, a pair of conveyors 240 are used at each end of the material transport system 100 to drive the system 100 for dispensing material at side walls 2, 3 when a roof 7 is present, or for dispensing material at end walls 4, 5 when a roof 7 is not present on a building 1. The flanged rollers 130 are used for moving the system 100, as in earlier embodiments, to dispense material at side walls 2, 3 when a roof is not present, and to dispense materials at end walls 4, 5 when a roof is present. In any case, the conveyors 240 are not necessarily attached to one another, as in earlier embodiments, but instead are slightly spaced from one another though in pairs at opposite ends of the material transport system, as before.

Thus, as shown in FIG. 10, a pair of conveyors 240 is mounted at each end of the material transport system 100. Each conveyor 240 of the pair is inversely mounted relative to the other conveyor such that one of the square drive axles 120 engages the drive pulley 242 of a first conveyor 240 and the other square drive axle 120 merely passes through the frame of the first conveyor 240, whereas the drive axle 120 passing through frame of the first conveyor 240 also engages the drive pulley 242 of the second conveyor 240, and the drive axle 120 engaging the drive pulley 242 of the first conveyor 140 merely passes through the frame of the second conveyor 240. A similar pair of conveyors 240 is provided at the opposite end of the material transport system.

As in earlier described embodiments, operation of motor 200 causes the drive axles 120 to engage the drive pulleys 242 of each conveyor 240. Rotation of the drive pulleys 242 results in the toothed belt 245 sliding over the idler pulleys 243 and 244, and over the elongated plastic slider element 260. The toothed belt 245 thus urges the material transport system 100 over the roof 7 to dispense materials at side walls 2, 3, and over the exposed purlins 6, when the roof is not present, to dispense materials at end walls 4, 5.

Figure 11:
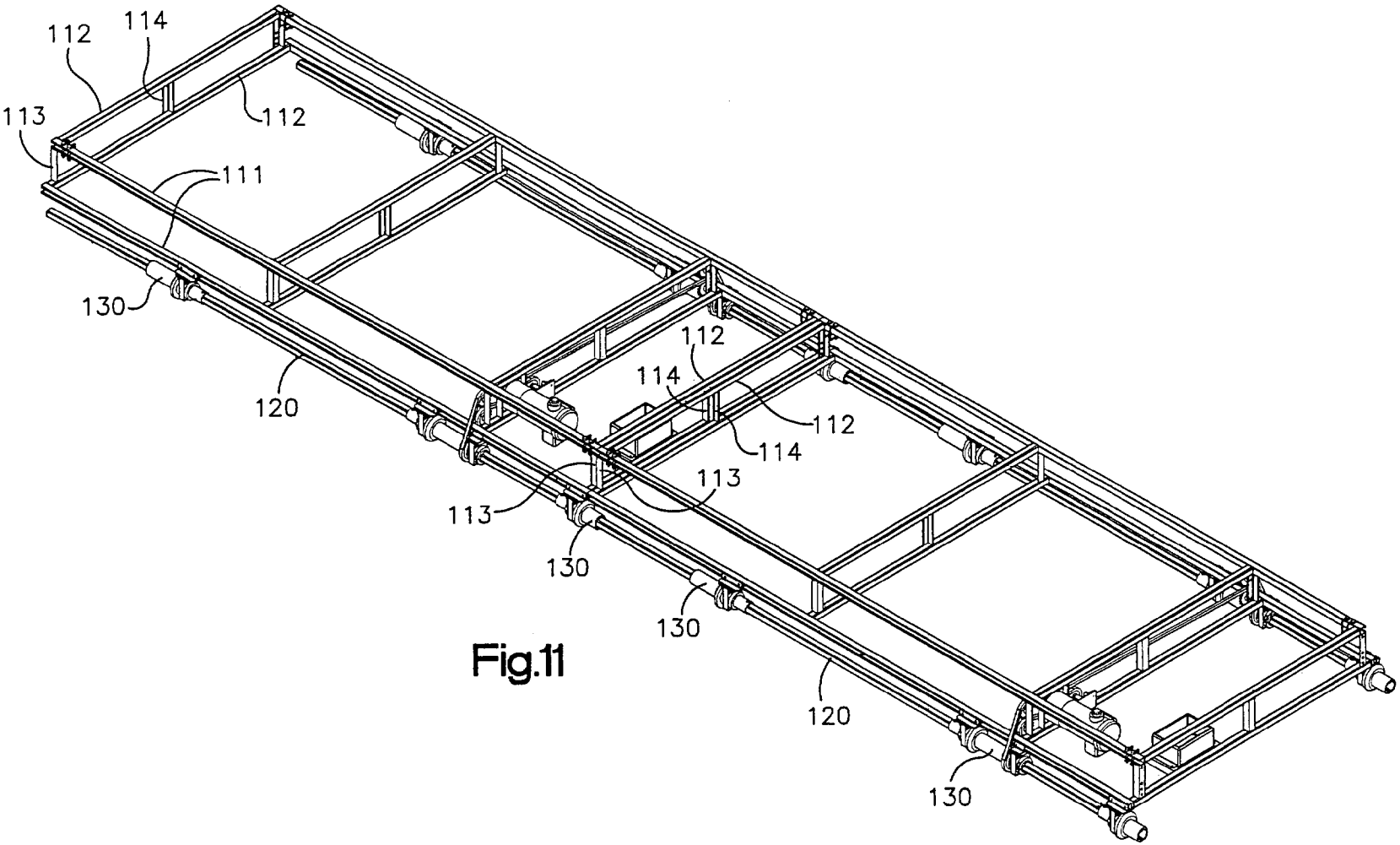
FIG. 11 illustrates an exemplary embodiment of multiple material transport systems coupled to one another.

FIG. 11 shows a series of material transport systems 100 connected to one another to form a train 300 of material transport systems 100. Such a train 300 may be useful to accommodate delivery of greater amounts of material to a work site. Because each frame 110 of each material transport system 100 is substantially the same as the other material transport systems 100, the train 300 may be achieved by fastening one end of a frame 110 of a first system 100 to an adjacent end of a frame 110 of another system 100 For example, a first material transport system 100 may be mechanically linked to a second material transport system 100 by fastening the frames 110 of each system 100 together as by bolting, or otherwise fastening adjacent struts 111, 112 and cornerposts 113 together. Alternatively, or in addition thereto, the drive axles 120 of each adjacent material transport system 100, may be linked by slidably positioning one of the flanged rollers 130 to bridge ends of the adjacent drive axles 120 together. Still further, and again in addition or alternatively to the above, adjacent material transport systems 100 could be electronically linked such that a single controller 210 (FIG. 5) operates the entire train 300. Such electronic linkage could, for example, operate each material transport system 100 of the train 300 in series off of one controller 210.

Of course, one skilled in the art would readily know and understand that the material transport systems 100 described herein may as easily transport material other than, or in addition to, the insulation, or other rolled materials described herein. For example, HVAC systems, bricks, mortar boxes, walling materials, etc., may as well be transported with minimizes manual intervention.

While this invention has been described in conjunction with the specific embodiments described above, it is evident that many alternatives, combinations, modifications, and variations are apparent to those skilled in the art. Accordingly, the exemplary embodiments of the invention set forth above are intended to be illustrative, and not limiting. Various changes can be made without departing from the spirit and scope of this invention.

What is claimed is:

1. Apparatus for transporting insulation materials across a roof structure comprising:

a frame;

at least two supply carriages adapted to carry said insulation materials thereon, each supply carriage comprising at least one substantially horizontal cross-member joined by substantially vertical corner posts, a pair of upright members adjustably mounted to the corner posts, a bar supported by the upright members at the upper end of the upright members, and at least one pair of wheeled members slideably received by the frame, wherein the bar carries a roll of insulation material to be dispensed and is angularly adjustable by varying the position of the upright members in the corner posts, wherein the corner posts and upright members provide the angular adjustment of the supply carriage by aligning a hole of each upright member with a corresponding hole in the respective corner post and securing upright members to the corner posts at a height provided by the aligned holes;

a drive axle connected to said frame; and drive means connected to said drive axle and said frame for moving said frame along said roof.

2. Apparatus as recited in claim 1 wherein said drive means comprises a set of flanged rollers mounted on said drive axle.

3. Apparatus for transporting insulation materials across a roof structure comprising:

a frame;

a supply carriage adapted to carry said insulation materials thereon;

a drive axle connected to said frame;

a motor in operative association with said drive axle for imparting rotational movement to said drive axle; and drive means connected to said drive axle and said frame for moving said frame along said roof, wherein said drive means comprises a pair of conveyors, said conveyors positioned so that one of said conveyors is positioned at a front end of said frame and the other of said conveyors is positioned at a back end of said frame.

4. Apparatus as recited in claim 3 wherein each of said conveyors comprises a belt drive for moving said frame along said roof structure.

5. A material transport system comprising:

a frame;

a supply carriage adjustably mounted to an upper portion of the frame;

a pair of drive axles mounted to an underside of the frame;

first and second drive systems;

said first drive system comprising a set of flanged rollers adjustably mounted to each drive axle for moving the material transport system according to building structure conditions;

said second drive system comprising at least one removable conveyor mountable at each end of the drive axles, the conveyors operating in tandem for moving the material transport system instead of the flanged rollers according to building structure conditions; and a motor operating rotation of the drive axles.

6. The material transport system of claim 5, further comprising:

a tensioning unit mounted at one end of the frame, the tensioning unit having a first position and a second position, the first position permitting materials supplied from the material transport system to pass through the tensioning unit, and the second position stopping materials from passing through the tensioning unit so as to render the dispensed material taut.

7. The material transport system of claim 6, wherein the tensioning unit further comprises:

a pair of parallel tensioning unit frame members mounted to an end of the frame;

a first pinch bar movably mounted between the parallel frame members;

a second pinch bar fixedly mounted between the parallel frame members, wherein movement of the first pinch bar determines the first and second position of the tensioning unit.

8. The material transport system of claim 7, wherein the tensioning unit further comprises:

a sprocket at least one end of the first pinch bar;

a retractable pin penetrating through each of the parallel frame members having a sprocket adjacent thereto, the retractable pin engaging a corresponding sprocket of the first pinch bar; and a crank mounted to at least one end of the first pinch bar for moving the first pinch bar to the first and second positions, whereby engagement of the retractable pin with the sprocket secures the first pinch bar in the desired one of the first and second position after movement of the first pinch bar by the crank.

9. The material transport system of claim 5, wherein the supply carriage further comprises:

a carriage frame having at least two wheeled members along a bottom of the carriage frame, the two wheeled members slidably mounting to a channel in the upper portion of the frame;

a pair of upright members adjustably mounted to a top of the carriage frame;

a bar spanning between the upright members and carrying material to be dispensed therefrom; and a supplemental support structure attaching one end of a first leg to an upper portion of the carriage frame, one end of a second leg to a corner of the carriage frame, and remaining ends of the first leg and second leg to the channel in the upper portion of the frame.

10. The material transport system of claim 5, wherein each conveyor further comprises:

a plurality of pulleys, at least one of which is a drive pulley, the drive pulley fitting over the respective drive axles; and at least one high-friction belt overriding the plurality of pulleys, the motion of the belt moving the material transport system.

11. The material transport system of claim 10, wherein a pair of conveyors are attached to one another and mounted to the drive axles at each end of the frame.

12. The material transport system of claim 5, wherein each conveyor further comprises:

a drive pulley;

two non-drive pulleys;

a slider element spanning between the drive pulley and the non-drive pulleys; and a toothed belt riding over the drive pulley, non-drive pulleys and slider element in response to rotation of the drive axles.

13. The material transport system of claim 8, wherein a pair of conveyors inversely oriented to one another are mounted to the drive axles at each end of the frame of the material transport system.

14. The material transport system of claim 5, wherein the motor operating the drive axles further comprises a drive chain connected to the drive axles by a series of sprockets, and a controller pennitting at least forward, reverse and stop motions of the drive chain.

15. The material transport system of claim 14, wherein a tethered control switch is attached to the controller to permit operation of the motor at a distance therefrom.

16. The material transport system of claim 9, wherein the supply carriage is adjustably mounted to accommodate changing elevations of the building structure the material transport system traverses.

17. The material transport system of claim 9, wherein the supply carriage contains members to appropriately separate each carriage as to keep each dispensing material from contacting the adjacent dispensing material.

18. The material transport system of claim 6, wherein the tensioning unit is adjustably mounted to accommodate changing elevations of a structure the material transport system traverses.

19. The material transport system of claim 5, wherein the flanged rollers comprise low-friction coated wheels on at least one side of a high-friction roller portion.

20. The material transport system of claim 19, wherein the building structure conditions are one of a roofed structure and a roofless structure, each condition having end walls and side walls, the elevation of the end walls varying and the elevation of the side walls being substantially constant.

21. The material transport system of claim 20, wherein the high-friction central roller portion of the flanged rollers moves the material transport system along exposed purlins, or joists, of a roofless structure to dispense materials at sidewalls, whereas the at least one conveyor moves the material transport system along the exposed purlins, or joists, of the roofless structure to dispense materials to endwalls.

22. The material transport system of claim 21, further wherein the high-friction central roller portion of the flanged rollers move the material transport system along the roof of the roofed structure to dispense materials to endwalls, whereas the at least one conveyor moves the material transport system along the roof of the roofed structure to dispense materials to sidewalls.

23. A plurality of material transport systems as recited in claim 15, wherein each system is connected to another to form a train of material transport systems.

24. The train of material transport systems as recited in claim 23, wherein each system is connected by at least one of mechanically linking the frames together, mechanically coupling the drive axles together, and electronically linking the controllers together.

25. The train of claim 24, wherein the frames are linked by bolts, the drive axles are coupled using the flanged rollers, and the controllers of each system is linked in series such that a single controller operates the train.

26. Apparatus as recited in claim 1 wherein said drive means comprises a pair of conveyors, said conveyors positioned so that one of said conveyors is positioned at a front end of said frame and the other of said conveyors is positioned at a back end of said frame.

27. Apparatus as recited in claim 26 wherein each of said conveyors comprises a belt drive for moving said frame along said roof structure.

28. Apparatus as recited in claim 1 wherein each supply carriage includes a supplemental support arm extending from the frame, wherein the supplemental support arm is comprised of a first extension member extending from a corner post on one side of the frame and a second extension member extending from a horizontal member on the same side of the frame, the first and second extension members meeting at a wheeled member away from the frame.

29. Apparatus as recited in claim 1 further comprising a braking device comprised of an upright biased towards the bar at a free end of the upright by a biasing device connecting a lower end of the upright to the frame.

30. Apparatus as recited in claim 29, wherein the biasing device is one of a pressurized cylinder or spring.

31. Apparatus as recited in claim 30, wherein the holes of the vertical posts and upright members correspond to standard roof pitches.

32. Apparatus as recited in claim 28, wherein the securing of the upright members in the vertical posts at the aligned holes is by pins penetrating through the aligned holes.

33. Apparatus as recited in claim 1 further comprising a motor in operative association with said drive axle for imparting rotational movement to said drive axle.

34. Apparatus as recited in claim 3 wherein said drive means further comprises a set of flanged rollers mounted on said drive axle.

* * * * *

UNITED STATES PATENT AND TRADEMARK OFFICE

CERTIFICATE OF CORRECTION

PATENT NO. : 7,008,161 B2
DATED : March 7, 2006
INVENTOR(S) : Jeffrey P. Wagner

It is certified that error appears in the above-identified patent and that said Letters Patent is hereby corrected as shown below:

Column 14,
Line 35, delete "pennitting" and insert -- permitting --.

Signed and Sealed this

Ninth Day of May, 2006

JON W. DUDAS
*Director of the United States Patent and Trademark Office*